United States Patent [19]

Goldsmith

[11] 3,934,798

[45] Jan. 27, 1976

[54] HEAT SAVING APPARATUS

[75] Inventor: Morris Goldsmith, Port Chester, N.Y.

[73] Assignee: Partnership of Goldsmith, Josephson & Gulko, Arlington, Va.

[22] Filed: Nov. 1, 1974

[21] Appl. No.: 520,183

[52] U.S. Cl. ..... 237/55; 165/DIG. 2

[51] Int. Cl.[2] ..... F24B 7/02

[58] Field of Search ..... 165/DIG. 2; 237/55; 126/121

[56] References Cited

UNITED STATES PATENTS

| | | | |
|---|---|---|---|
| 114,013 | 4/1871 | Jennings | 237/55 X |
| 1,487,709 | 3/1924 | Besser | 165/DIG. 2 |
| 2,084,408 | 6/1937 | Mueller | 165/DIG. 2 |
| 2,252,784 | 8/1941 | Powers | 165/DIG. 2 |
| 2,902,265 | 9/1959 | Dubovick | 237/55 X |

*Primary Examiner*—William E. Wayner
*Assistant Examiner*—William E. Tapolcai, Jr.
*Attorney, Agent, or Firm*—Dressler, Goldsmith, Clement & Gordon, Ltd.

[57] ABSTRACT

A simplified heat exchanging system is provided for saving heat in a forced draft home heating system by directing air from a return register to the return plenum through a heat exchanger interposed in the line of the flue and having an enlarged casing extending between tapered collars and enclosing heat exchange tubes having about the same cross-sectional area as the flue.

5 Claims, 2 Drawing Figures

HEAT SAVING APPARATUS

The present invention relates to apparatus which can be easily installed in a conventional forced draft home heating system for conserving heat while utilizing the existing fan in the furnace to draw the return air through the apparatus of this invention.

In the conventional forced draft home heating system, air is blown through the furnace where combustion occurs and the hot products of combustion pass through a heat exchanger where useful heat is transferred to the air circulating within the structure being heated. The partially cooled combusion products are then passed via a flue to a chimney where they exit from the building.

The partially cooled combusion products frequently contain a great deal of residual heat, and numerous efforts have been made to utilize this residual heat, but the structures involved have been cumbersome, inefficient, and difficult to install so that these are rarely used even though the flue gases in most home heating systems contain a considerable amount of recoverable heat.

In this invention a heat exchanger having opposed tapered collars at each end of an enlarged casing is installed in the flue between the furnace and the chimney. The return air from a return grill in the system is tied into one end of the casing with the other end being tapped into the return plenum of the circulating air system. In this way the existing air circulating fan functions to draw the return air from the return grill through the heat exchanger and then into the return plenum. This heats some of the air entering the furnace, raising its temperature and the temperature of the heated air leaving the furnace and thus renders the entire system more efficient. At the same time, the heat exchange structure is a simple one, it is easily installed between the furnace and the chimney, and the flue is not obstructed, as will be explained hereinafter, so the operation of the furnace is unchanged.

Figure 1:
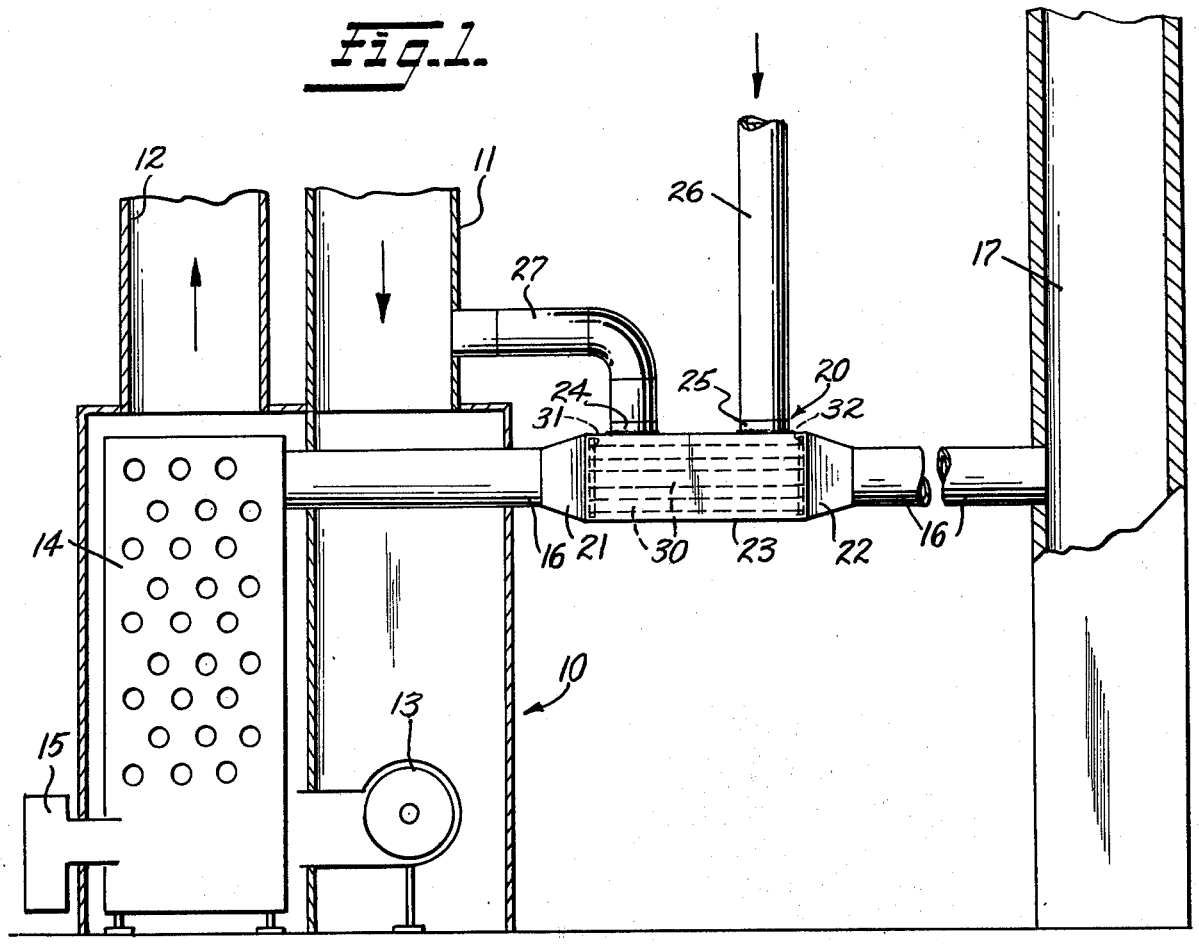
Figure 2:
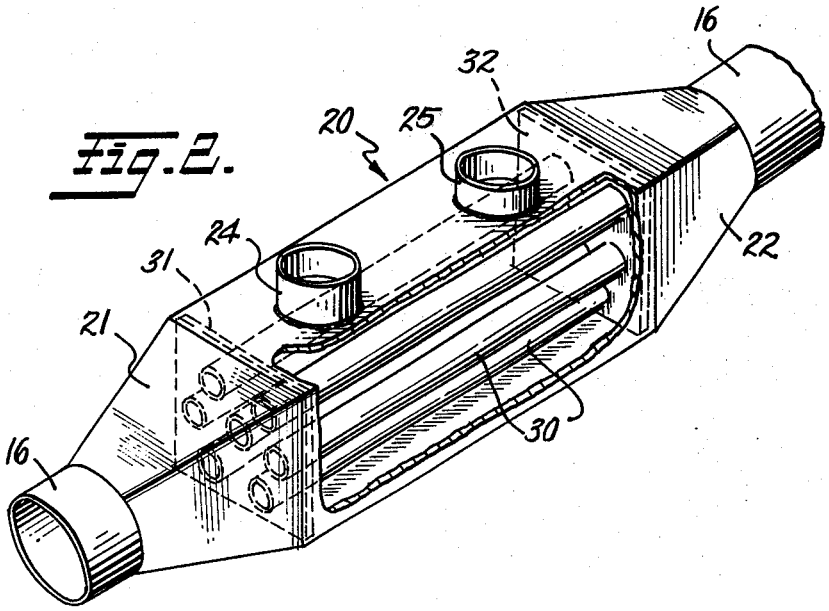

The invention will be more fully understood by reference to the accompanying drawing in which:

FIG. 1 is a side elevation, partially in section, and partially diagrammatic, and showing the overall positioning of parts in accordance with the invention; and FIG. 2 is a perspective view of the heat exchanger, a protion of the outer casing being broken away to show the interior structure.

Referring more particularly to FIG. 1, the numeral 10 identifies a furnace having a return plenum 11 and a supply plenum 12, air being circulated through the system by fan 13, the air circulation being indicated by arrows. The combustion chamber itself is identified at 14, air being forced through the combustion chamber 14 by oil burner 15 and natural or forced draft, here illustrated by a burner including a fan to provide a forced draft, the combustion products exiting via flue 16 and chimney 17. To this point, the structure is entirely conventional which explains the diagrammatic nature of much of the drawing.

A heat exchanger 20 is shown installed in the line of the flue 16. It will be seen that the heat exchanger 20 is formed with opposed tapered collars 21 and 22 between which extends an enlarged casing 23 having openings 24 and 25 at its opposite ends. While tapered collars are primarily contemplated, it is only necessary for the collar to engage the flue and expand outwardly to connect with the enlarged casing.

A duct 26 communicates between a return register in the air circulation system and one of the openings in the casing 23 (opening 25), and a duct 27 communicates between the return plenum 11 and the other opening (opening 24).

As will now be apparent, fan 13 will draw air through the return plenum 11 and through the furnace 10 where it is heated and sent on its way through supply plenum 12. At the same time, air is also drawn from a return register through duct 26, casing 23 of heat exchanger 20, and then, through duct 27 to the return plenum 11 where it mingles with the intake air to warm the same and increase the thermal efficiency of the entire system.

The heat exchange 20 is of simple construction as shown in FIG. 2. As can be seen, the tapered collars 21 and 22 fit onto the flue 16, making installation simple. It is essential that these collars be tapered since this accommodates a casing 23 of larger cross-section on the flue 16.

Extending between the inner enlarged ends of the collars 21 and 22 is a heat exchange unit constituted by a plurality of tubes 30 which are fastened in an air tight manner at their opposite ends to end plates 31 and 32. The casing 23 is then fastened in an air tight manner onto the end plates 31 and 32 and this provides a sealed chamber within the casing 23 and outside of the tubes 30 within which air can be heated without being contaminated by the flue gases.

The collars 21 and 22 are then joined to the casing 23, as by welding, and this provides the heat exchanger 20 shown in FIG. 2, ready to be fitted in the flue line, as pictured in both FIGS. 1 and 2. It is stressed that the cross-sectional area of the tubes is about the same as the area of the flue 16 so that the flue is not obstructed.

The openings 24 and 25 for attachment to the ducts 26 and 27 are clearly pictured in FIG. 2.

The invention is defined in the claims which follow.

I claim:

1. In a forced draft home heating system comprising a furnace having a return plenum, a supply plenum, fan means for circulating air through an air circulating system including said furnace and said plenums, a combustion chamber, a chimney, a flue communicating therebetween and means for combustion gases to flow through said chamber, flue and chimney, the improvement comprising a heat exchanger interposed along a portion of the length of said flue, said heat exchanger having opposed tapered collars which engage with said flue and connect with a casing of enlarged cross-section extending therebetween, said casing enclosing a plurality of longitudinal tubes extending between opposed end plates from one collar to the other and providing a chamber within said casing and outside of said tubes, openings at opposite ends of said casing, the opening at one end of said casing being connected to a return register in said air circulating system and being separate from said return plenum, and the opening at the other end of said casing being connected to said return plenum to interconnect the existing fan means in said furnace with said return register via said chamber and said return plenum so that some of the air entering the furnace is preheated while the remainder of the air circulating in the system is not preheated.

2. Apparatus as recited in claim 1 in which the cross-sectional area of said sealed chamber is about the same as the cross-sectional area of said flue.

3. Apparatus as recited in claim 1 in which a fan provides a forced draft which blows combustion gases through said chamber, tubes and chimney.

4. In a forced draft home heating system comprising a furnace having a return plenum, a supply plenum, fan means for circulating air thorugh an air circulating system including said furnace and said plenums, a combustion chamber, a chimney, a flue communicating therebetween and means for combustion gases to flow through said chamber, flue and chimney, the improvement comprising a heat exchanger interposed along a portion of the length of said flue, said heat exchanger having opposed collars which engage with said flue and connect with a casing of enlarged cross-section extending therebetween, said casing enclosing a plurality of longitudinal tubes extending between opposed end plates from one collar to the other and proving a chamber within said casing, said tubes having approximately the same cross-sectional area as said flue, openings at opposite ends of said casing, the opening at one end of said casing being connected to said return plenum to interconnect the existing fan means in said furnace with the opening on the other end of said casing via said chamber within said casing and said return plenum so that some of the air entering the furnace is preheated while the remainder of the air circulating in the system is not preheated, said opening on the other end of said casing being separate from said return plenum.

5. Apparatus as recited in claim 4 in which blower means are provided to blow combustion gases through said chamber, flue and chimney.

* * * * *